US011203858B1

(12) United States Patent
Hsieh

(10) Patent No.: US 11,203,858 B1
(45) Date of Patent: Dec. 21, 2021

(54) SINK DRAIN

(71) Applicant: Shun-Fa Hsieh, Changhua (TW)

(72) Inventor: Shun-Fa Hsieh, Changhua (TW)

( * ) Notice: Subject to any disclaimer, the term of this patent is extended or adjusted under 35 U.S.C. 154(b) by 0 days.

(21) Appl. No.: 17/074,106

(22) Filed: Oct. 19, 2020

(51) Int. Cl.
*E03C 1/23* (2006.01)

(52) U.S. Cl.
CPC ..... *E03C 1/2306* (2013.01)

(58) Field of Classification Search
CPC ..... E03C 1/22; E03C 1/23; E03C 1/2302; E03C 1/2304; E03C 1/2306; E03C 1/232; E03C 1/26; E03C 1/262
See application file for complete search history.

(56) References Cited

U.S. PATENT DOCUMENTS 4,860,390 A * 8/1989 Ohta ..... A47K 1/14 4/295
2004/0154095 A1* 8/2004 Rhodes ..... E03C 1/2306 4/684
2011/0138527 A1* 6/2011 Siena ..... E03C 1/2306 4/295
2018/0355588 A1* 12/2018 Sodo ..... E03C 1/2306

* cited by examiner

*Primary Examiner* — Janie M Loeppke
(74) *Attorney, Agent, or Firm* — Che-Yang Chen; Law Office of Michael Chen

(57) ABSTRACT

A sink drain may include a drainage tube, a strainer, an O-shaped sealing pad, a push-type water valve, and a general bolt. The drainage tube has a blocking edge at an upper end thereof, and a thread nut is disposed on the drainage tube. The strainer has a cup-shaped main body, and a thread portion is formed on the outer periphery of a lower section of the main body. The thread nut of the drainage tube is engaged with the thread portion of the strainer to complete the connection between the drainage tube and the strainer. The sealing pad, which is elastically deformable, has a first section and a second section, and the first section having a larger diameter than the second section is located above the second section. The push-type water valve with a second O-ring is downwardly put into a third drainage hole of a sink.

4 Claims, 9 Drawing Sheets

SINK DRAIN

FIELD OF THE INVENTION

The present invention relates to a sink drain and more particularly to a push-type sink drain that can be applied to different types of sinks.

BACKGROUND OF THE INVENTION

Generally, a water sink has a drainage hole which is connected to a drainage tube which is configured to discharge water in the sink, and on the other hand, in order to store water in the sink or filter waste from water when discharging, a sink drain is installed in the drainage hole of the sink.

There are two types of sinks in the market which are the single-layer sink and the double-layer sink. The single-layer sink comprises a drainage hole at the bottom of the sink. The double-layer sink which has hollow inner and outer layers, and an overflow hole is formed on the inner layer at a preferred height, and each of bottom portions of the inner layer and the outer layer comprises one drainage hole at corresponding positions.

However, the conventional sink drain has following disadvantages: the different types of sinks need different sink drains, which leads higher manufacturing costs and makes things inconvenience for consumers. Therefore, there remains a need for a new and improved design for a sink drain to overcome the problems presented above.

SUMMARY OF THE INVENTION

The present invention provides a sink drain comprising a drainage tube, a strainer, an O-shaped sealing pad, a push-type water valve, and a general bolt. The drainage tube has a blocking edge at an upper end thereof, and a thread nut is disposed on the drainage tube from bottom to top. The blocking edge is configured to block and couple with the thread nut, and the thread nut is only rotatable when assembling and is not detachable from the upper end of the drainage tube, and a first O-ring arranged on the inner periphery of the thread nut is positioned on the upper end of the drainage tube. The strainer has a cup-shaped main body, and a thread portion is formed on the outer periphery of a lower section of the main body. The thread nut of the drainage tube is engaged with the thread portion of the strainer to complete the connection between the drainage tube and the strainer. The first O-ring is adapted to achieve the sealing effect between the main body and the drainage tube. A lock hole axially penetrates through the center of a bottom portion of the main body, and a plurality of axial first drainage holes are formed around the lock hole. A first connecting hole having a larger diameter than the main body is formed at an upper end of the main body. The sealing pad, which is elastically deformable, has a first section and a second section, and the first section having a larger diameter than the second section is located above the second section. The second section is inserted into the first connecting hole of the strainer, and the first section of the sealing pad is abutted against a bottom end of a sink when the sink drain installed. The push-type water valve comprises a cup-shaped valve base and a telescopic rod, and the telescopic rod is connected to a water stopper. The valve base has a second connecting hole axially penetrating through the center of a bottom portion thereof, and a plurality of axial second drainage holes are formed around the second connecting hole, and a second O-ring is coupled with the valve base. The valve base with the second O-ring is downwardly put in a third drainage hole of the sink, and the general bolt is configured to pass through the second connecting hole and be downwardly screwed into the lock hole of the strainer. The strainer and the valve base are installed on the sink, and the depth that the general bolt downwardly screws into the lock hole is arranged according to different thicknesses of the sinks such that the sink drain of the present invention is applied to the single-layer sink and the double-layer sink. The general bolt is screwed to drive the strainer to upwardly abut against the sealing pad, and the deformed sealing pad is configured to achieve the sealing effect on the bottom end of the sink and the valve base. The water stopper is connected at the upper end of the telescopic rod, and a lower portion of the telescopic rod is secured in the second connecting hole of the valve base.

Comparing with conventional sink drain, the present invention is advantageous because: (i) the sink drain can be applied to both the single-layer sink and the double-layer sink so as to lower manufacturing costs and make things convenience for consumers; and (ii) with the first section having larger diameter, the contact area between the sealing pad and the bottom end of the sink is increased so as to achieve the effective sealing effect.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
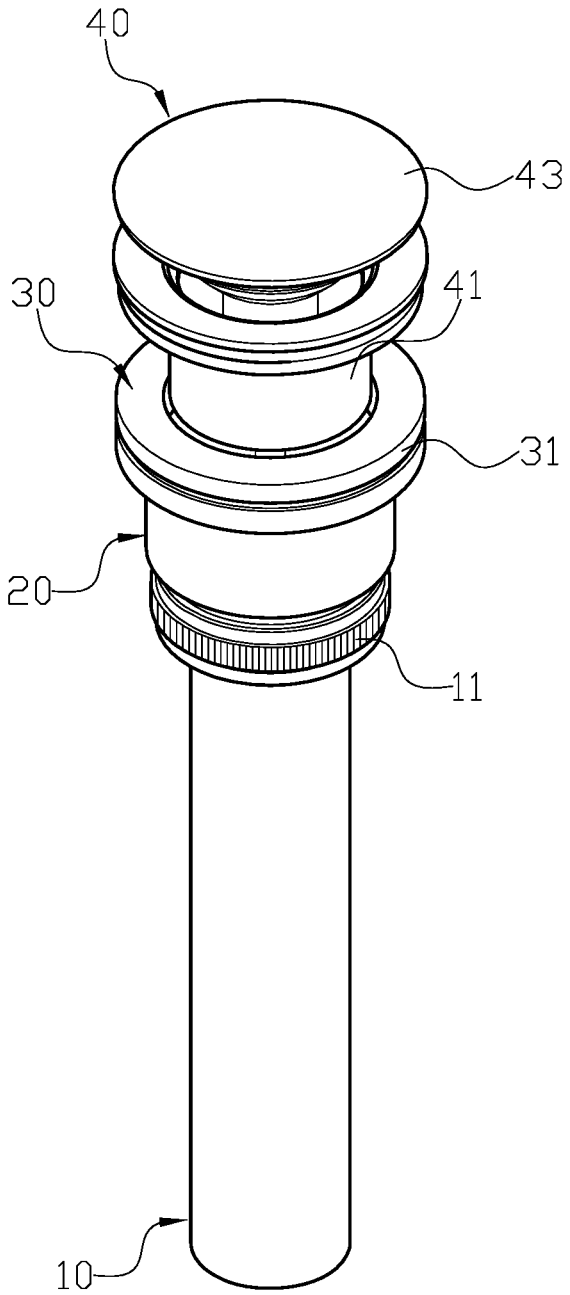
FIG. 1 is a three-dimensional assembly view of a sink drain of the present invention.
Figure 2:
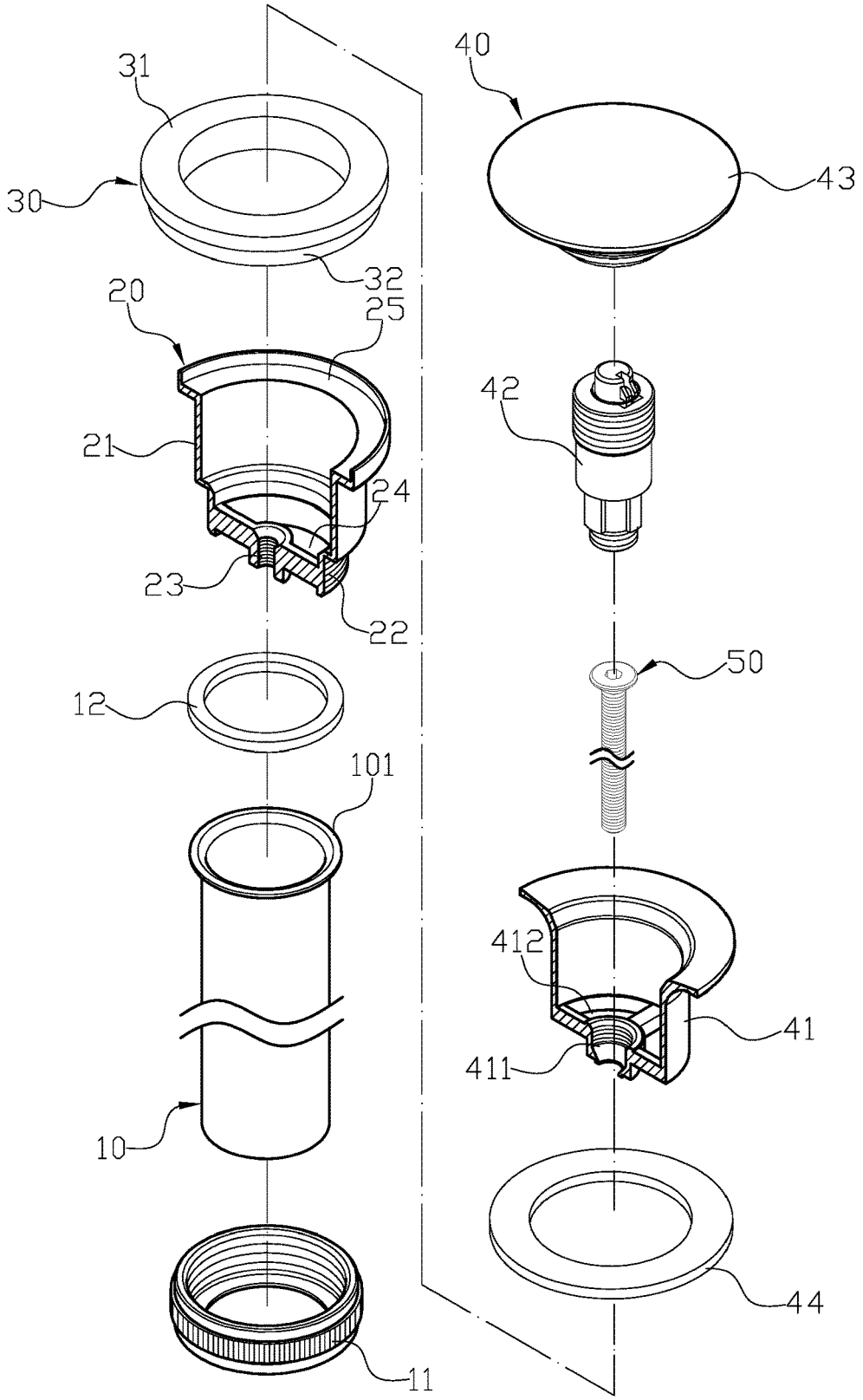
FIG. 2 is a three-dimensional exploded view of the sink drain of the present invention.
Figure 3:
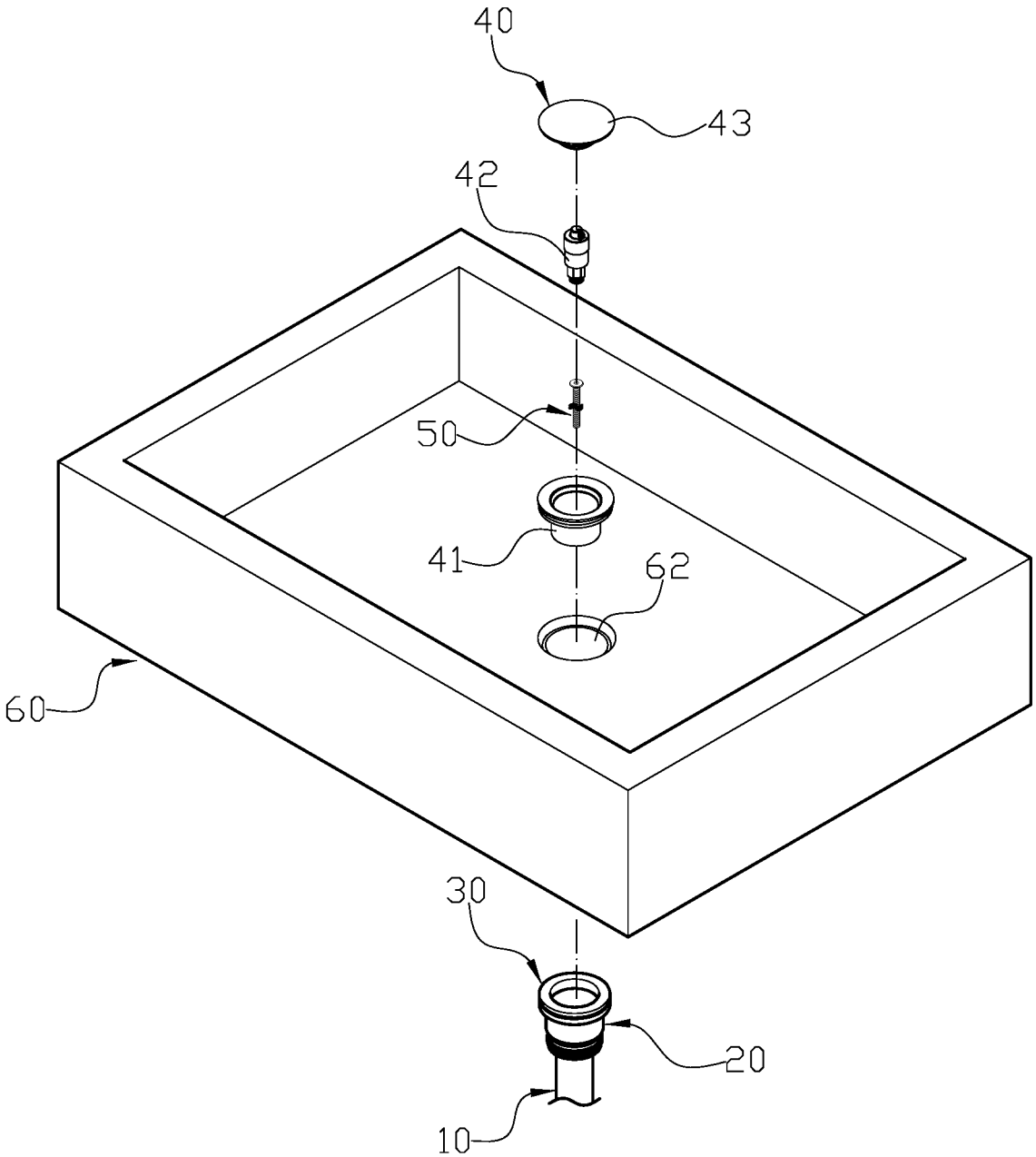
FIG. 3 is a schematic view illustrating the sink drain of the present invention is applied to a single-layer sink.
Figure 4:
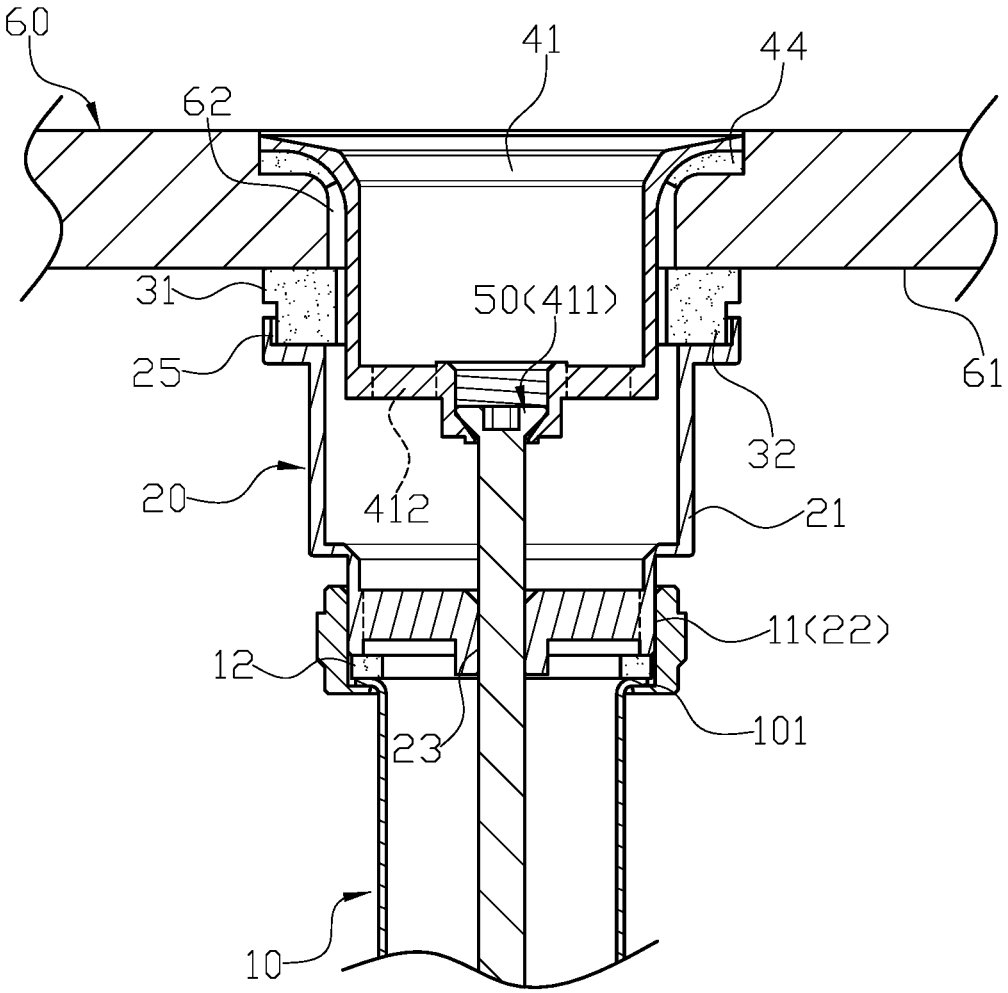
FIG. 4 is a sectional view illustrating the sink drain of the present invention is applied to the single-layer sink.
Figure 5:
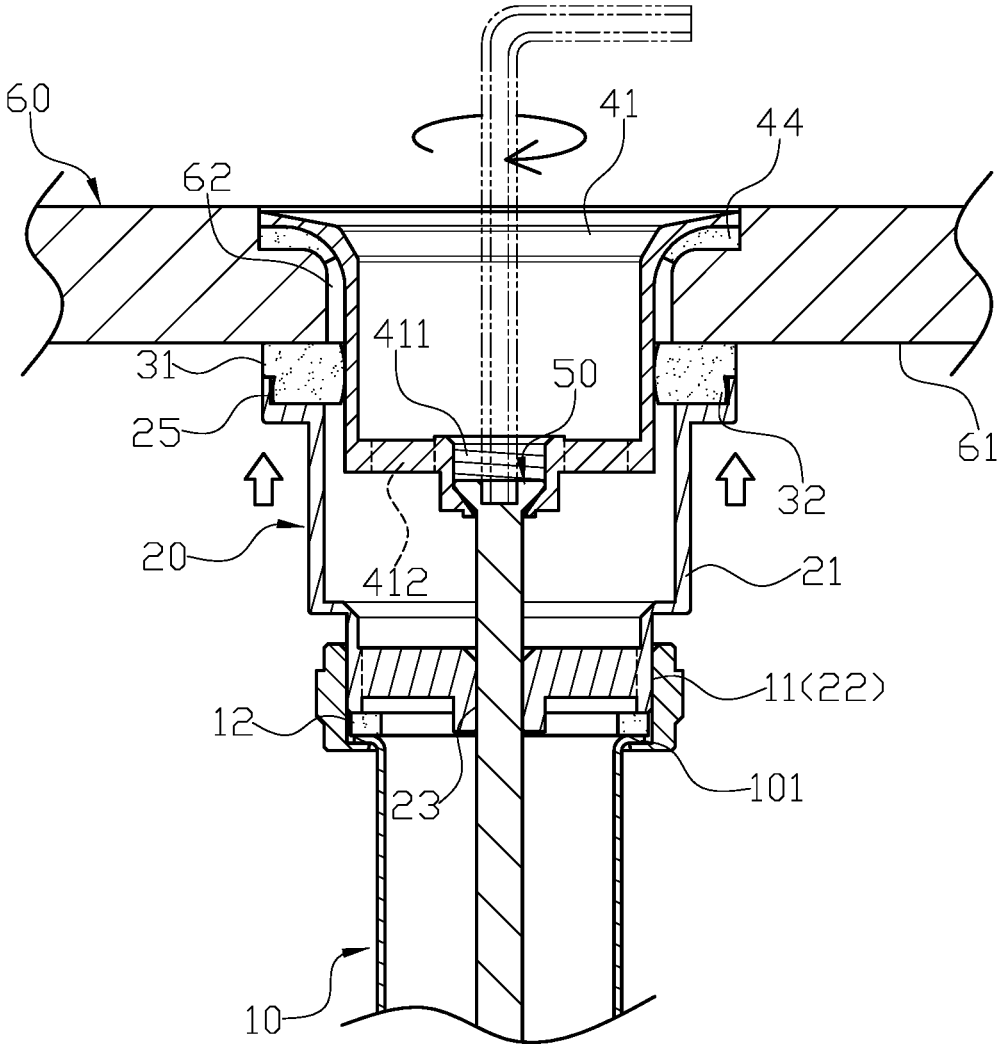
FIG. 5 is a schematic view illustrating the sink drain of the present invention is locked on the single-layer sink.
Figure 6:
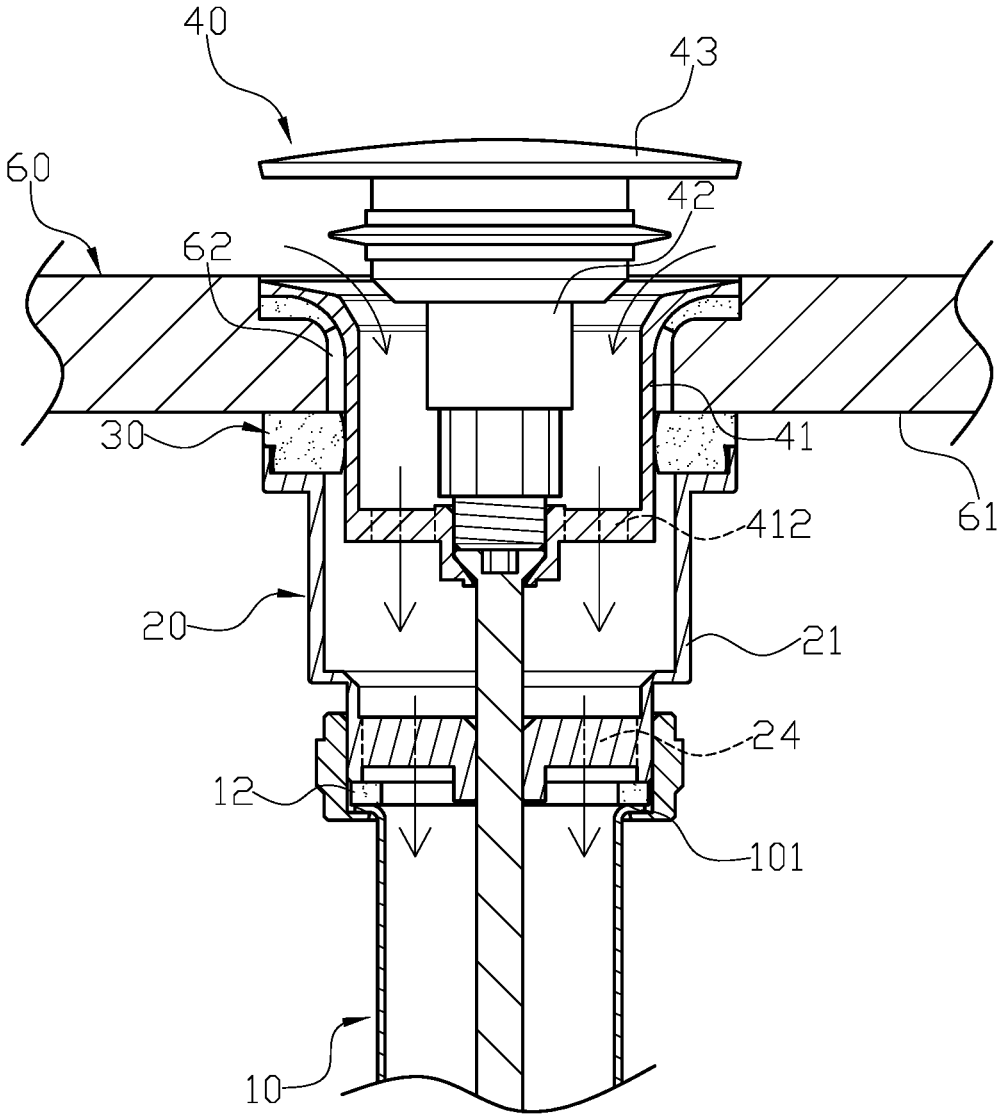
FIG. 6 is a schematic view illustrating the sink drain of the present invention applied to the single-layer sink is discharging.
Figure 7:
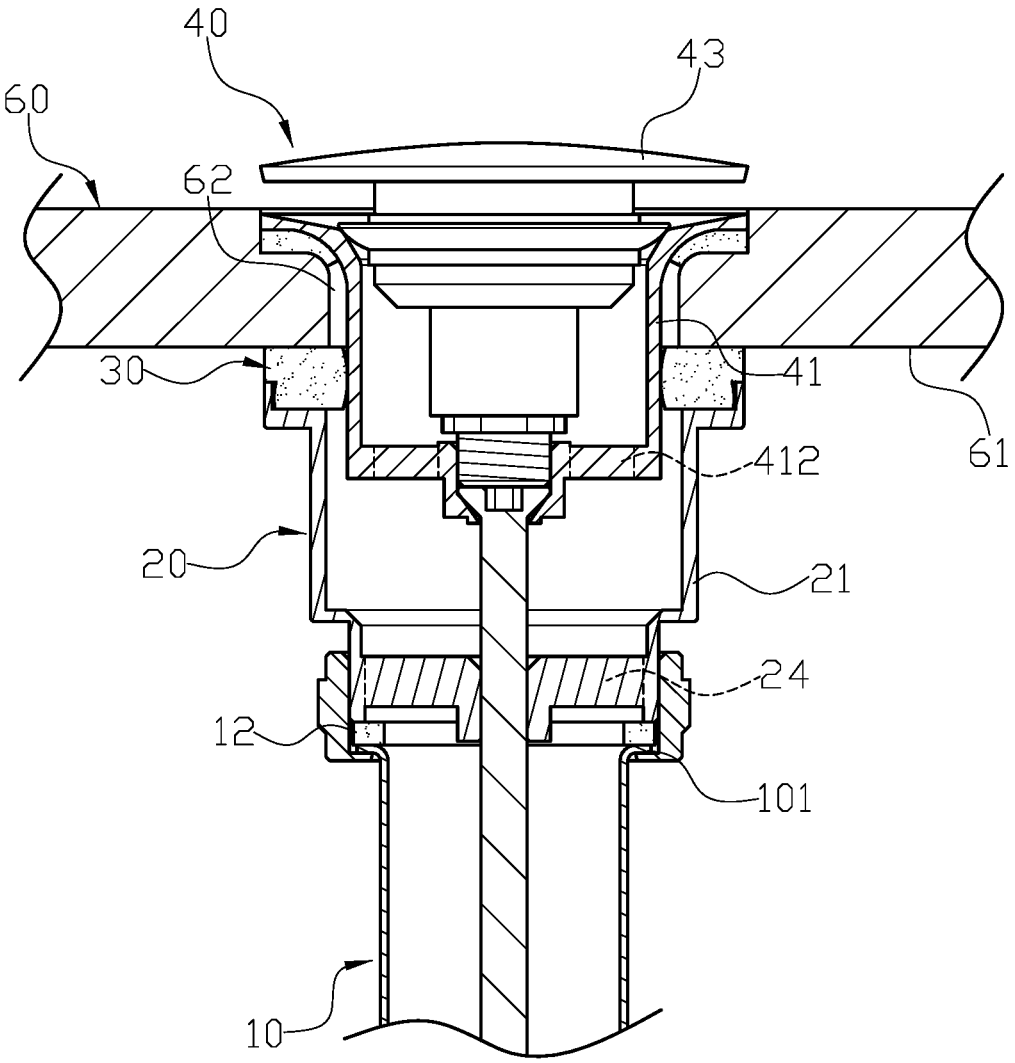
FIG. 7 is a schematic view illustrating the sink drain of the present invention is at water-stop position.
Figure 8:
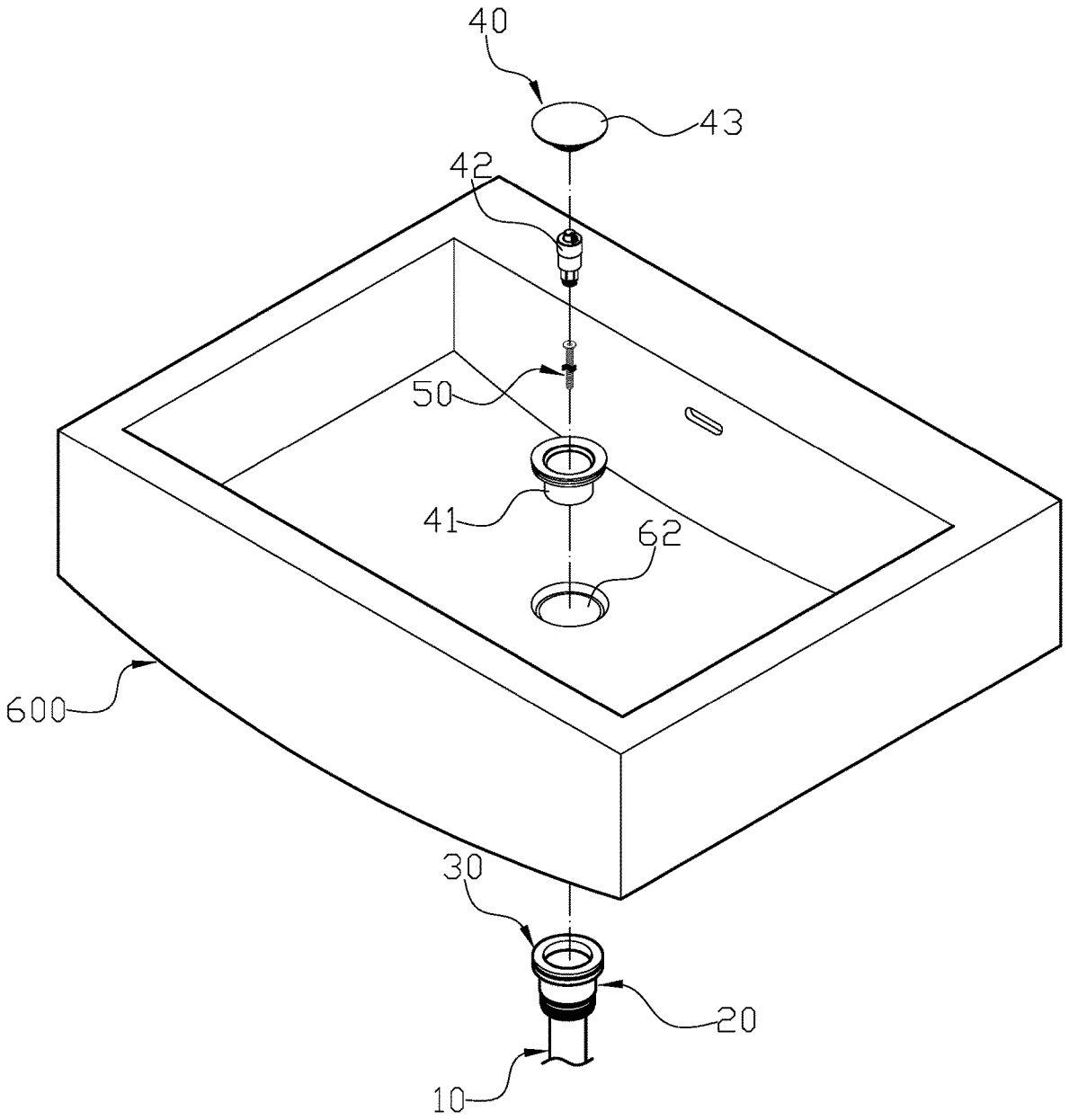
FIG. 8 is a schematic view illustrating the sink drain of the present invention is applied to a double-layer sink.
Figure 9:
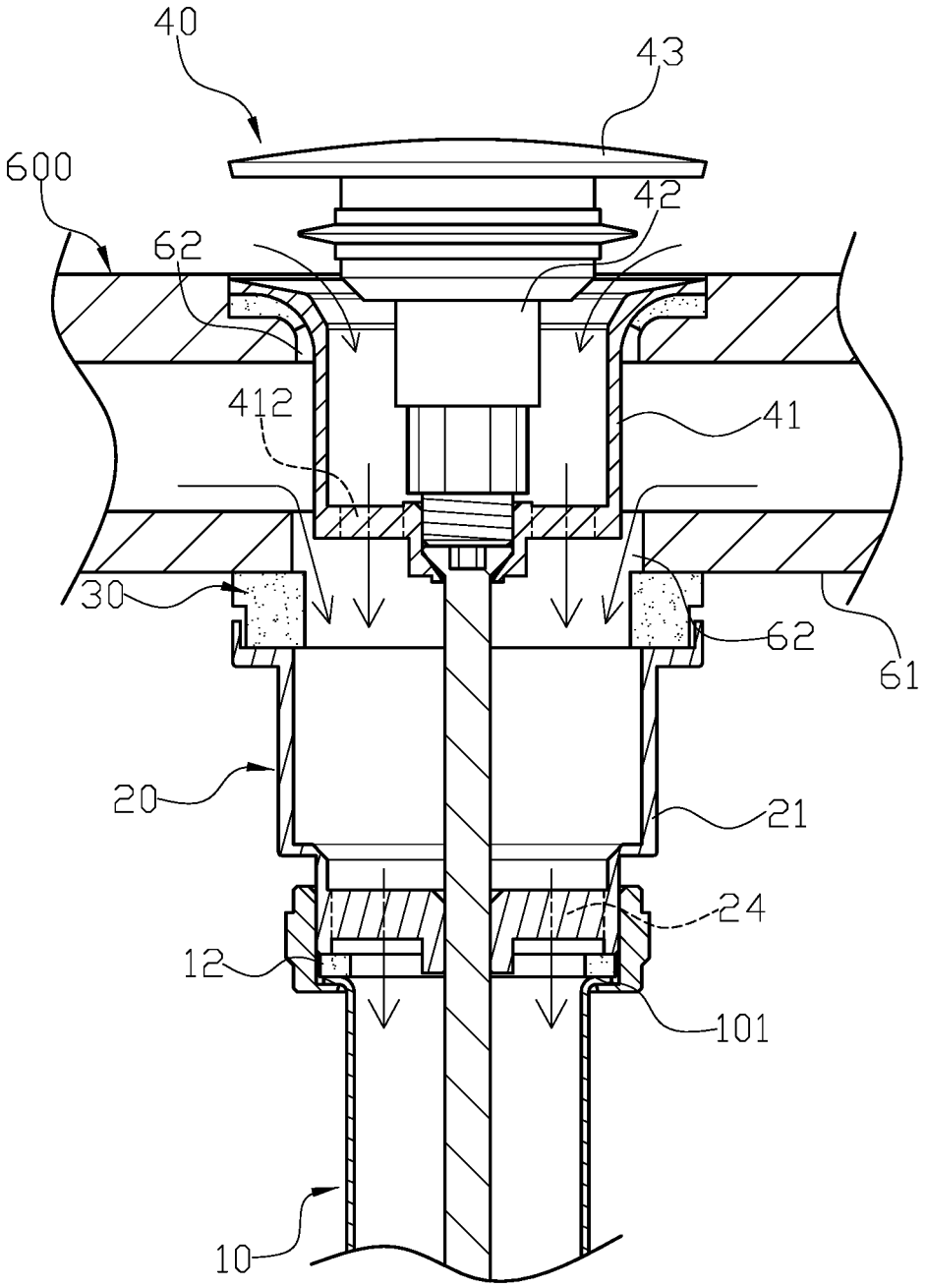
FIG. 9 is a schematic view illustrating the sink drain of the present invention applied to the double-layer sink is discharging.

In order to further understand the goal, characteristics and effect of the present invention, a number of embodiments along with the drawings are illustrated as following:

Referring to FIGS. 1 to 7, the present invention provides a sink drain comprising a drainage tube (10), a strainer (20), an O-shaped sealing pad (30), a push-type water valve (40), and a general bolt (50). The drainage tube (10) has a blocking edge (101) at an upper end thereof, and a thread nut (11) is disposed on the drainage tube (10) from bottom to top. The blocking edge (101) is configured to block and couple with the thread nut (11), and the thread nut (11) is only rotatable when assembling and is not detachable from the upper end of the drainage tube (10). Moreover, a first O-ring (12) arranged on the inner periphery of the thread nut (11) is positioned on the upper end of the drainage tube (10). The strainer (20) has a cup-shaped main body (21), and a thread portion (22) is formed on the outer periphery of a lower section of the main body (21). The thread nut (11) of the drainage tube (10) is engaged with the thread portion (22) of the strainer (20) to complete the connection between the drainage tube (10) and the strainer (20). The first O-ring (12) is adapted to achieve the sealing effect between the main body (21) and the drainage tube (10). Furthermore, a lock hole (23) axially penetrates through the center of a bottom portion of the main body (21), and a plurality of axial first drainage holes (24) are formed around the lock hole (23). Also, a first connecting hole (25) having a larger diameter than the main body (21) is formed at an upper end of the main body (21). The sealing pad (30), which is elastically deformable, has a first section (31) and a second section (32), and the first section (31) having a larger diameter than the second section (32) is located above the second section (32). The second section (32) is inserted into the first connecting hole (25) of the strainer (20), and the first section (31) of the sealing pad (30) is abutted against a bottom end (61) of a single-layer sink (60) when the sink drain installed. The push-type water valve (40) comprises a cup-shaped valve base (41) and a telescopic rod (42), and the telescopic rod (42) is connected to a water stopper (43). The valve base (41) has a second connecting hole (411) axially penetrating through the center of a bottom portion thereof, and a plurality of axial second drainage holes (412) are formed around the second connecting hole (411), and a second O-ring (44) is coupled with the valve base (41). The valve base (41) with the second O-ring (44) is downwardly put in a third drainage hole (62) of the single-layer sink (60), and the general bolt (50) is configured to pass through the second connecting hole (411) and be downwardly screwed into the lock hole (23) of the strainer (20). The strainer (20) and the valve base (41) are installed on the sink, and the depth that the general bolt (50) downwardly screws into the lock hole (23) is arranged according to different thicknesses of the sinks such that the sink drain of the present invention is applied to the single-layer sink (60) and the double-layer sink (600) (as shown in FIGS. 8 and 9). The general bolt (50) is screwed to drive the strainer (20) to upwardly abut against the sealing pad (30), and the deformed sealing pad (30) is configured to achieve the sealing effect on the bottom end (61) of the sink (60)(600) and the valve base (41) (as shown in FIG. 5). The water stopper (43) is connected at the upper end of the telescopic rod (42), and a lower portion of the telescopic rod (42) is secured in the second connecting hole (411) of the valve base (41).

In one embodiment, the upper end of the drainage tube (10) is bent outwardly to form the blocking edge (101).

In another embodiment, the main body (21) has a lower portion having a smaller diameter than the main body (21), and the thread portion (22) is formed on the lower portion.

In still another embodiment, after the general bolt (50) passes through the second connecting hole (411), the telescopic rod (42) is engaged with the second connecting hole (411) to enable the head portion of the general bolt (50) to be completely concealed in the second connecting hole (411).

In actual application, when discharging, the water in the sink is configured to flow through the valve base (41), the second drainage holes (412), and the first drainage hole (24) of the strainer (20) out of the drainage tube (10) (as shown in FIGS. 6 and 9). Also, the user can press the water stopper (43) downwardly to block water flowing into the valve base (41), thereby holding water in the sink (as shown in FIG. 7). Moreover, the double-layer sink (600) comprises an overflow hole so that when the water level in the sink is too high, water is adapted to be discharged from the overflow hole through the internal hollow portion of the double-layer sink (60), the third drainage hole (62), the strainer (20), and out from the drainage tube (10) (as shown in FIG. 9), thereby preventing water from overflowing from the top of the double-layer sink (600).

Comparing with conventional sink drain, the present invention is advantageous because: (i) the sink drain can be applied to both the single-layer sink (60) and the double-layer sink (600) so as to lower manufacturing costs and make things convenience for consumers; and (ii) with the first section (31) having larger diameter, the contact area between the sealing pad (30) and the bottom end (61) of the sink (60)(600) is increased so as to achieve the effective sealing effect.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A sink drain comprising a drainage tube, a strainer, an O-shaped sealing pad, a push-type water valve, and a general bolt;

wherein the drainage tube has a blocking edge at an upper end thereof, and a thread nut is disposed on the drainage tube from bottom to top; the blocking edge is configured to block and couple with the thread nut, and the thread nut is only rotatable when assembling and is not detachable from the upper end of the drainage tube, and a first O-ring arranged on the inner periphery of the thread nut is positioned on the upper end of the drainage tube;

wherein the strainer has a cup-shaped main body, and a thread portion is formed on the outer periphery of a lower section of the main body; the thread nut of the drainage tube is engaged with the thread portion of the strainer to complete the connection between the drainage tube and the strainer; the first O-ring is adapted to achieve the sealing effect between the main body and the drainage tube; a lock hole axially penetrates through the center of a bottom portion of the main body, and a plurality of axial first drainage holes are formed around the lock hole; a first connecting hole having a larger diameter than the main body is formed at an upper end of the main body;

wherein the sealing pad, which is elastically deformable, has a first section and a second section, and the first section having a larger diameter than the second section is located above the second section; the second section is inserted into the first connecting hole of the strainer, and the first section of the sealing pad is abutted against a bottom end of a sink when the sink drain installed; and wherein the push-type water valve comprises a cup-shaped valve base and a telescopic rod, and the telescopic rod is connected to a water stopper; the valve base has a second connecting hole axially penetrating through the center of a bottom portion thereof, and a plurality of axial second drainage holes are formed around the second connecting hole, and a second O-ring is coupled with the valve base; the valve base with the second O-ring is downwardly put in a third drainage hole of the sink, and the general bolt is configured to pass through the second connecting hole and be downwardly screwed into the lock hole of the strainer; the strainer and the valve base are installed on the sink, and the depth that the general bolt downwardly screws into the lock hole is arranged according to different thicknesses of the sinks such that the sink drain of the present invention is applied to the single-layer sink and the double-layer sink; the general bolt is screwed to drive the strainer to upwardly abut against the sealing pad, and the deformed sealing pad is configured to achieve the sealing effect on the bottom end of the sink and the valve base; and the water stopper is connected at the upper end of the telescopic rod, and a lower portion of the telescopic rod is secured in the second connecting hole of the valve base.

2. The sink drain of claim 1, wherein the upper end of the drainage tube is bent outwardly to form the blocking edge.

3. The sink drain of claim 1, wherein the main body has a lower portion having a smaller diameter than the main body, and the thread portion is formed on the lower portion.

4. The sink drain of claim 1, wherein the lower portion of the telescopic rod is screwed and secured in the second connecting hole of the valve base.

* * * * *